US012392088B2

(12) United States Patent
Hiltunen et al.

(10) Patent No.: US 12,392,088 B2
(45) Date of Patent: Aug. 19, 2025

(54) AQUEOUS SLURRY FOR A COATING COLOUR COMPOSITION FOR PAPER, BOARD OR THE LIKE

(71) Applicant: KEMIRA OYJ, Helsinki (FI)

(72) Inventors: Jaakko Hiltunen, Espoo (FI); Annaleena Kokko, Espoo (FI); Tapio Honkanen, Espoo (FI)

(73) Assignee: KEMIRA OYJ, Helsinki (FI)

( * ) Notice: Subject to any disclaimer, the term of this patent is extended or adjusted under 35 U.S.C. 154(b) by 183 days.

(21) Appl. No.: 18/019,894

(22) PCT Filed: Sep. 16, 2021

(86) PCT No.: PCT/FI2021/050612
§ 371 (c)(1),
(2) Date: Feb. 6, 2023

(87) PCT Pub. No.: WO2022/058655
PCT Pub. Date: Mar. 24, 2022

(65) Prior Publication Data

US 2023/0313465 A1 Oct. 5, 2023

(30) Foreign Application Priority Data

Sep. 18, 2020 (FI) ..... 20205902

(51) Int. Cl.
*D21H 19/52* (2006.01)
*D21H 21/08* (2006.01)
*D21H 21/28* (2006.01)

(52) U.S. Cl.
CPC ..... *D21H 19/52* (2013.01); *D21H 21/08* (2013.01); *D21H 21/28* (2013.01)

(58) Field of Classification Search
CPC ..... D21H 19/52; D21H 21/08; D21H 21/28; D21H 17/23; D21H 17/67; D21H 17/69; D21H 19/44; D21H 17/74; D21H 19/385; D21H 19/40
See application file for complete search history.

(56) References Cited

U.S. PATENT DOCUMENTS 4,861,376 A 8/1989 Edwards et al.
5,498,534 A * 3/1996 Jeffries ..... D21C 5/005 435/200
2009/0114356 A1 5/2009 Silenius
2014/0273108 A1* 9/2014 Bleyer ..... C12P 19/14 435/165
2016/0151754 A1 6/2016 Yokoyama et al.
2018/0142417 A1 5/2018 Haakana et al.
2018/0327311 A1* 11/2018 Kalliola ..... C04B 24/34
2019/0091643 A1 3/2019 Lewis
2021/0148052 A1 5/2021 Bohn-Stoltz et al.

FOREIGN PATENT DOCUMENTS

EP 0288291 A2 10/1988
EP 0325852 A2 8/1989
EP 3561177 A1 * 10/2019 ..... D21H 11/04
WO 2017007614 A1 1/2017
WO 2017077198 A1 5/2017

OTHER PUBLICATIONS

International Search Report and Written Opinion in Application No. PCT/FI2021/050612, mailed Jan. 4, 2022, 11 pages.
Dominguez-Robles, Juan, et al. "Aqueous acetone fractionation of kraft, organosolv and soda lignins" International Journal of Biological Macromolecules 106 (2018) 979-987.
Abbadessa, Anna, et al. "Characterization of Two Novel Bio-based Materials from Pulping Process Side Streams: Ecohelix and CleanFlow Black Lignin", BioResources 13(4), 7606-7627, 2018.
Tenhunen, Tiia-Maria, et al. "Enhancing the Stability of Aqueous Dispersions and Foams Comprising Cellulose Nanofibrils (CNF) with CaCO3 Partiles", Nanomaterials 2018, 8,651; doi:10.3390/nano8090651.
Nypelö, Tiina, et al. "Tailoring Surface Properties of Paper Using Nanosized Precipitated Calcium Carbonate Particles", Applied Materials & Interfaces Sep. 2011, 30, 3725-3731.
Search Report mailed on Aug. 31, 2024, in Chinese Application No. 202180057431X.

* cited by examiner

*Primary Examiner* — Abbas Rashid
*Assistant Examiner* — Matthew M Eslami
(74) *Attorney, Agent, or Firm* — Meunier Carlin & Curfman LLC

(57) ABSTRACT

The invention relates to an aqueous slurry for manufacture of a coating composition for paper, board or the like, which comprises inorganic mineral particles and a dispersion agent, which is an anionic lignin-carbohydrate complex where lignin and carbohydrate are covalently bound with each other.

12 Claims, No Drawings

AQUEOUS SLURRY FOR A COATING COLOUR COMPOSITION FOR PAPER, BOARD OR THE LIKE

CROSS REFERENCES

This application is a U.S. national stage application of international patent application number PCT/FI/2021/050612 filed on Sep. 16, 2021 claiming priority to Finnish national application number FI20205902 filed on Sep. 18, 2020.

FIELD OF INVENTION

The present invention relates to an aqueous slurry for a coating colour composition for paper, board or the like and to a use of an anionic lignin-carbohydrate complex according to the enclosed independent claims.

BACKGROUND

Aqueous slurries comprising inorganic mineral particles are widely used in various industries. For example, in manufacture of paper, board or the like aqueous slurries comprising inorganic mineral particles are used for preparing coating colour compositions. The coating colour compositions are applied on the surface of the paper, board or the like, where they improve, among other things, the strength, printability and appearance of the paper, board or the like. The coating colour compositions are based on aqueous slurries of inorganic mineral particles, into which binder and possible other additives, such as co-binders, preservatives, dispersion agents, defoaming agents, lubricants, hardeners, and optical brighteners, are added. The main ingredient of the coating colour composition is, however, the inorganic mineral particles.

When coating colour compositions are prepared, the inorganic mineral particles are slurried with water. In order to improve the stability and workability of the aqueous slurries containing inorganic mineral particles a dispersion agent is usually added to the aqueous phase of the slurry. The dispersion agent improves, for example, the high and/or low shear viscosity properties of the slurry. The dispersion agent also ensures proper behaviour, for example stability, of the coating colour composition both during its handling before its application as well as during its application on the paper, board or the like.

A number of dispersion agents are already known. However, many of the conventional dispersion agents are synthetic polymers, which originate from petroleum-based raw materials. In view of the present desire to increase the use of materials that originate from renewable sources, it is clear that there is an interest to replace, wholly or partly, the petroleum-based synthetic polymer dispersion agents. At the same time, however, the properties of the aqueous slurries containing inorganic mineral particles, such as viscosity and stability, should be maintained at the same level in order to be able to use them for making coating colour compositions intended for paper, board or the like.

SUMMARY OF THE INVENTION

An object of this invention is to minimise or possibly even eliminate the disadvantages existing in the prior art.

An object is also to provide an aqueous slurry comprising inorganic mineral particles, which comprises a dispersion agent obtained from renewable sources.

A further object of this invention is also to provide an aqueous slurry comprising inorganic mineral particles, which is stable and easy to prepare, and which is suitable for use in preparation of coating colour compositions for coating of paper, board or the like.

These objects are attained with the invention having the characteristics presented below in the characterising parts of the independent claims. Some preferable embodiments are disclosed in the dependent claims.

The features recited in the dependent claims and the embodiments in the description are mutually freely combinable unless otherwise explicitly stated.

The exemplary embodiments presented in this text and their advantages relate by applicable parts to all aspects of the invention, even though this is not always separately mentioned.

A typical aqueous slurry according to the present invention for manufacture of a coating colour composition for paper, board or the like comprises inorganic mineral particles and a dispersion agent, which is an anionic lignin-carbohydrate complex.

A typical use of an anionic lignin-carbohydrate complex according to the present invention is as a dispersing agent for inorganic mineral particles in an aqueous slurry for coating colour compositions for paper, board or the like.

Now it has been surprisingly found out that an anionic lignin-carbohydrate complex where lignin and carbohydrate(s) are covalently bound to each other can be used as a dispersion agent in aqueous slurries comprising inorganic mineral particles. The aqueous slurries which are thus obtained have at least similar, sometimes even improved properties, such as viscosity and/or stability, compared with aqueous slurries of inorganic mineral particles where conventional synthetic petroleum-based dispersion agents are used. The present invention provides a possibility to effectively decrease the use of synthetic petroleum-based dispersion agent polymers and to increase the use of substances originating from renewable sources. The aqueous slurries thus obtained are especially suitable for manufacture of coating colour compositions for coating of paper, board or the like.

DETAILED DESCRIPTION OF THE INVENTION

The anionic lignin-carbohydrate complex suitable for use in the present invention is a natural polymeric complex that comprises lignin and carbohydrate(s), preferably hemicellulose(s), which are covalently bound with each other. The lignin-carbohydrate complex is thus a conjugate of lignin and at least one carbohydrate, which are irreversibly bound which each other to an integral structure. Lignin and carbohydrate(s) of the complex cannot be separated from each other without permanently damaging the structure of the complex. The anionic lignin-carbohydrate complex may have a branched structure. For example, the lignin or the carbohydrate may form a backbone structure for the complex and the other component, either carbohydrate or lignin, may form pendant groups, which are covalently bound to the backbone structure.

The lignin-carbohydrate complex may be formed of lignin and one or more of carbohydrates, such as hemicelluloses. The carbohydrate(s) in the lignin-carbohydrate complex may preferably be formed from monosaccharides, such as galactose, glucose, mannose, arabinose and/or xylose. The exact amounts of the monosaccharides and their relative ratios depend on the wood species, e.g. hardwood/softwood, which has been used in the pulping process and from which the lignin-carbohydrate complex originates. The monosaccharides may be present in the lignin-carbohydrate complex as sugar residues, covalently bound to the lignin.

The lignin-carbohydrate complex may comprise various anionic functional groups, such as sulfonate groups, carboxyl groups, phenolic groups and/or any of their combinations. The lignin-carbohydrate complex may comprise, for example, >1300-1700 μmol/g, preferably 1400-1600 μmol/g of sulfonate groups; 300-500 μmol/g, preferably 350-450 μmol/g of carboxyl groups; and/or 125-250 μmol/g, preferably 150-225 μmol/g of phenolic groups.

The lignin-carbohydrate complex, suitable for use in the present invention, may be obtained, for example, from a side stream of a pulping process. In one embodiment, a suitable lignin-carbohydrate complex may be obtained by enzymatic treatment of lignin-carbohydrate material originating from a pulping process. For example, the lignin-carbohydrate complex may be obtained by isolating lignin-carbohydrate material from side streams of wood pulping processes by filtration, such as membrane filtration, and by processing the said isolated lignin-carbohydrate material by enzymatic processing employing preferably laccase enzyme. Alternatively, lignin-carbohydrate complex may be isolated from lignocellulosic material, such as wood or pulp, by using separation and fractionation methods known as such. For example, it is possible to isolate lignin-carbohydrate complexes by fractionating lignin from an industrial process, such as kraft pulping or sulphite pulping. Suitable lignin fractionating methods include, for example, solvent fractionation or precipitation fractionation. In solvent fractionation various organic solvents and their binary mixtures may be employed, such as acetone-hexane, acetone-water, ethanol-water, propyleneglycol monomethyl ether-water. Such fractionation method is described, inter alia, in Int. J. Biol. Macromolecules 106 (2018) 979-987.

According to one preferable embodiment of the invention the anionic lignin-carbohydrate complex is an anionic lignosulfonate-carbohydrate complex. It can be obtained, for example, by membrane filtration of a pre-hydrolysis mixture from a sulphite pulping process of wood, and thereafter treated by an enzymatic oxidative treatment, preferably by laccase enzyme. Preferably the filtered pre-hydrolysis mixture is obtained from a sulphite pulping process of wood. The pre-hydrolysis mixture may contain wood-based components and pulping chemicals. Suitable anionic lignosulfonate-carbohydrate complex is disclosed e.g. in BioResources 13 (4), 7606-7627, 2018, and they are commercially available from Ecohelix AB, Sweden.

The anionic lignin-carbohydrate complex may have an anionic charge density less than −0.2 meq/g, preferably less than −0.5 meq/g, more preferably less than −0.85 meq/g, measured at pH 7. The anionic charge density of the complex may be from −0.2 meq/g to −2.5 meq/g, preferably from −0.5 meq/g to −2.4 meq/g, more preferably from −0.85 meq/g to −2.3 meq/g measured at pH 7. Sometimes the anionic charge density of the complex may be from −0.5 meq/g to −1.75 meq/g, preferably from −0.85 to −1.5 meq/g, measured at pH 7. The anionic charge density of the complex may even be from −2.0 meq/g to −2.3 meq/g, preferably from −2.1 to −2.2 meq/g, measured at pH 7. All charge density values are given as per dry substance, and measured by using a Mütek Particle Charge Detector.

The lignin-carbohydrate complex may have a weight average molecular weight MW >3500 g/mol, preferably >4000 g/mol, more preferably >5000 g/mol. The lignin-carbohydrate complex may have the weight average molecular weight MW in a range of 3500-90000 g/mol, preferably 4000-80000 g/mol, more preferably 5000-70000 g/mol.

According to one embodiment, the lignin-carbohydrate complex may preferably have relatively high molecular weight. It is assumed, without wishing to be bound by a theory, that the high molecular weight provides at least some of the surprising effects that have been observed. The lignin-carbohydrate complex may have a weight average molecular weight MW >8000 g/mol, preferably >10000 g/mol, more preferably >12000 g/mol or >15000 g/mol, sometimes even>20000 g/mol or >25000 g/mol. The lignin-carbohydrate complex may have the weight average molecular weight MW in a range of 8000-50000 g/mol or 10000-45000 g/mol, preferably 12000-40000 g/mol or 15000-37000 g/mol. Sometimes the lignin-carbohydrate complex may have the weight average molecular weight MW in a range of 20000-45000 g/mol, preferably 25000-40000 g/mol, more preferably 25000-35000 g/mol or 25000-27000 g/mol. According to one embodiment the lignin-carbohydrate complex may have the weight average molecular weight MW in a range of 15000-120000 g/mol or 20000-90000 g/mol, preferably 25000-80000 g/mol, more preferably 30000-70000 g/mol.

The lignin-carbohydrate complex may comprise lignin and carbohydrate(s), preferably hemicellulose(s), in a ratio from 90:10 to 10:90, preferably from 80:20 to 20:80, more preferably from 75:25 to 25:75 (lignin:carbohydrate). According to one embodiment of the invention the lignin-carbohydrate complex may comprise at least 10 weight-%, preferably at least 15 weight-% of carbohydrate(s), preferably hemicellulose(s), calculated from total dry weight of the complex. The lignin-carbohydrate complex may comprise carbohydrate(s) in a range of 10-40 weight-%, 10-30 weight-% or 15-25 weight-%, calculated from total dry weight of the complex.

According to one embodiment of the invention the aqueous slurry comprises lignin-carbohydrate complex in amount of 0.01-10 pph, preferably 0.05-5 pph, more preferably 0.1-3 pph, calculated per 100 parts of the inorganic mineral particles. Sometimes the aqueous slurry may comprise lignin-carbohydrate complex in amount of 0.1-3.5 pph, preferably 0.25-3.0 pph, more preferably 0.5-2.5 pph or 1.0-2.0 pph, calculated per 100 parts of the inorganic mineral particles. In the present context the amounts of the individual components of the composition are given, if not otherwise stated, as conventional in the art, by giving the total amount of inorganic mineral particles a value 100, and calculating the amounts of other components relative to the amount of the total amount of inorganic mineral. Proportions of all components are given as dry parts and as active agents.

The aqueous slurry according to the present invention comprising inorganic mineral particles and lignin-carbohydrate complex is stable. It has been observed that the lignin-carbohydrate complex helps the inorganic mineral particles to remain dispersed in the water phase of the aqueous slurry, and as a result no phase separation in the slurry or viscosity change is observed as a function of time. The unchanged viscosity of the slurry comprising inorganic mineral particles, as a function of time, is one clear indication of the stability of the aqueous slurry. According to one embodiment the difference between a first viscosity value, measured for the aqueous slurry immediately after its preparation, and a second viscosity value, measured for the aqueous slurry after 2 hours from its preparation, is less than 10%, preferably less than 7.5%, more preferably less than 5%.

Inorganic mineral particles that may be used in the present invention are those which are typically used in manufacture of coating colour compositions for coating of paper, board and the like. The inorganic mineral particles may be selected from calcium carbonate, kaolin, calcinated kaolin, talc, titanium dioxide, gypsum, or any of their mixtures. Calcium carbonate may be ground calcium carbonate (GCC) or precipitated calcium carbonate (PCC) or their mixture. Preferably the inorganic mineral pigment is selected from kaolin, precipitated calcium carbonate, ground calcium carbonate and any of their mixtures. The aqueous slurry may comprise inorganic mineral particles of one or several inorganic minerals having particle size D50<5 μm. According to one embodiment the aqueous slurry comprises coating grade inorganic mineral particles, wherein at least 45% of the inorganic mineral particles has a particle size <2 μm.

The aqueous slurry comprising inorganic mineral particles may be prepared simply by adding the anionic lignin-carbohydrate complex as the dispersion agent to the aqueous phase. Then any suitable inorganic mineral in particle, paste or cake form, such as precipitated calcium carbonate or titanium dioxide, is added to the aqueous phase with any suitable means, e.g. screw conveyor, and the final aqueous slurry is obtained by mixing of the aqueous phase and inorganic mineral particles.

The aqueous slurry may have a solids content in the range of 20-80 weight-%, preferably 40-70 weight-%, more preferably 50-70 weight-%. Typically, the aqueous slurry of inorganic mineral particles comprises at least 20 weight-% of water.

The aqueous slurry according to the present invention is especially suitable for coating colour compositions used for coating of paper, board, and the like. According to one embodiment the aqueous slurry may have a viscosity of ≤2500 mPas, preferably ≤2000 mPas, measured with Brookfield viscometer, type DV-E, 100 rpm, at 23° C. Appropriate spindle for the measuring range is used. The viscosity of the aqueous slurry according to the present invention may be in the range of 500-2500 mPas, typically 1000-2000 mPas.

The aqueous slurry may further comprise at least one thickener.

EXPERIMENTAL

Example 1

Use of anionic lignosulphonate-carbohydrate complexes A1, A2 and A3 were tested as a dispersion agent for clay pigment particles (coating grade, minimum 45% of particles smaller than 2 μm) in Example 1. Lignosulphonate-carbohydrate complexes A1 (DS 7.15 w-%), A2 (DS 10.75 w-%) and A3 (DS 26.1 w-%) were obtained from Ecohelix AB, Sweden. The reference dispersion agent B was a commercial polyacrylate dispersion agent (DS 40 w-%, FennoDispo A41, Kemira Oyj).

Used water and clay mineral amounts were calculated so that the final slurry had a dry solids content of 72 weight-%.

In the experiment 100 pph clay pigment particles was added to water and mixed in a high shear mixer for 15 min. Viscosity of the aqueous clay slurry was measured using Brookfield viscometer, type DV-E, with speeds 100 rpm and 50 rpm and using appropriate spindle in measuring range, at 23° C. Used dispersion agent was added step-wise, 0.025 pph at a time. After each addition aqueous clay slurry was mixed again for 10 min and the viscosity was measured.

Viscosity measurements were performed at 0 pph, 0.025 pph, 0.05 pph, 0.075 pph and 0.1 pph addition levels of the dispersion agent. As conventional in the art, the total amount of clay pigment is given the value 100, and the amounts of other components are calculated relative to the amount of the total pigment and given in pph (parts per 100). All components are given as active dry parts.

The results of Example 1 are shown in Table 1.

It is seen from Table 1 that the anionic lignosulphonate-carbohydrate complexes A1, A2 and A3 provide similar viscosity values for the aqueous clay slurry than the commercial dispersion agent. This indicates that the lignosulphonate-carbohydrate complexes A1, A2 and A3 can be used to replace wholly or partially commercial dispersion agent conventionally used for dispersing clay pigment in water slurries.

The project leading to this application has received funding from the Bio Based Industries Joint Undertaking (JU) under grant agreement No 837866. The JU receives support from the European Union's Horizon 2020 research and innovation programme and the Bio Based Industries Consortium.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

TABLE 1

Results of Example 1

| | Dispersion agent amount | dry solids content | T | | Viscosity [mPas] | |
|---|---|---|---|---|---|---|
| | [pph] | [w-%] | [° C.] | pH | 100 rpm | 50 rpm |
| Clay (0-test) | — | 71.63 | 24.7 | 7.2 | 1570 | 2648 |
| Clay+ commercial dispersion agent B | 0.025 | 71.74 | 26 | 7.1 | 1218 | 1808 |
| | 0.05 | 71.8 | 26 | 7.3 | 672 | 976 |
| | 0.075 | — | 25.6 | 7.3 | 645 | 948 |
| | 0.1 | — | 25.5 | 7.3 | 673 | 1014 |
| Clay+ dispersion agent A1 | 0.025 | 71.62 | 25.4 | 7.1 | 1158 | 1892 |
| | 0.05 | 71.4 | 25.1 | 7.2 | 773 | 1226 |
| | 0.075 | 71.2 | 24.7 | 7.3 | 692 | 1104 |
| | 0.1 | 71.4 | 24.8 | 7.2 | 698 | 1086 |
| Clay+ dispersion agent A2 | 0.025 | 71.65 | 25.1 | 7.3 | 1490 | 2468 |
| | 0.05 | 71.65 | 25.3 | 7.2 | 1170 | 1872 |
| | 0.075 | 71.54 | 25.0 | 7.1 | 942 | 1540 |
| | 0.1 | 71.34 | 25.0 | 7.1 | 846 | 1376 |
| Clay+ dispersion agent A3 | 0.025 | 71.7 | 26.0 | 7.3 | 1420 | 2240 |
| | 0.05 | 71.8 | 25.8 | 7.2 | 1082 | 1704 |
| | 0.075 | 71.8 | 25.9 | 7.2 | 958 | 1508 |
| | 0.1 | 71.8 | 26 | 7.2 | 888 | 1408 |

The invention claimed is:

1. An aqueous slurry for manufacture of a coating colour composition for paper or board, the slurry comprising inorganic mineral particles and a dispersion agent, which is an anionic lignin-carbohydrate complex, where lignin and one or more carbohydrates are covalently bound with each other, wherein the one or more carbohydrates in the anionic lignin-carbohydrate complex are formed from monosaccharides and the lignin-carbohydrate complex has a weight average molecular weight MW >8000 g/mol, wherein the lignin-carbohydrate complex has a lignin:carbohydrate ratio from 90:10 to 10:90, and wherein the difference between a first viscosity value, measured for the slurry immediately after its preparation, and a second viscosity value, measured for the slurry after 2 hours, is less than 10%.

2. The aqueous slurry according to claim 1, wherein the anionic lignin-carbohydrate complex comprises anionic functional groups selected from sulfonate groups, carboxyl groups and/or phenolic groups.

3. The aqueous slurry according to claim 1, wherein the lignin-carbohydrate complex has the weight average molecular weight MW >10000 g/mol.

4. The aqueous slurry according to claim 3, wherein the lignin-carbohydrate complex has the weight average molecular weight MW in a range of 10000-45000 g/mol.

5. The aqueous slurry according to claim 1, wherein the anionic lignin-carbohydrate complex has an anionic charge density less than −0.2 meq/g measured at pH 7.

6. The aqueous slurry according to claim 5, wherein the lignin-carbohydrate complex has the anionic charge density from −0.2 meq/g to −2.5 meq/g measured at pH 7.

7. The aqueous slurry according to claim 1, wherein the lignin-carbohydrate complex comprises at least 10 weight-%, carbohydrates, calculated from total dry weight of the complex.

8. The aqueous slurry according to claim 1, wherein the lignin-carbohydrate complex comprises galactose, glucose, mannose, arabinose and/or xylose residues, which are covalently bound to a lignin.

9. The aqueous slurry according to claim 1, wherein the slurry has a solids content of 20-80 weight-%.

10. The aqueous slurry according to claim 1, wherein the slurry comprises lignin-carbohydrate complex in amount of 0.01-10 pph, calculated per 100 parts of the inorganic mineral particles.

11. The aqueous slurry according to claim 1, wherein the inorganic mineral particles are selected from kaolin, precipitated calcium carbonate, ground calcium carbonate and any of their mixtures.

12. The aqueous slurry according to claim 1, wherein the slurry has a viscosity of <2500 mPas, measured with Brookfield DV-E, 100 rpm, at 23° C.

* * * * *